US008210650B2

(12) United States Patent
Ishizuka et al.

(10) Patent No.: US 8,210,650 B2
(45) Date of Patent: Jul. 3, 2012

(54) LIQUID DISCHARGE HEAD

(75) Inventors: Kazunari Ishizuka, Suntou-gun (JP); Shimpei Otaka, Yokohama (JP); Isao Imamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1071 days.

(21) Appl. No.: 12/128,327

(22) Filed: May 28, 2008

(65) Prior Publication Data

US 2008/0309719 A1 Dec. 18, 2008

(30) Foreign Application Priority Data

Jun. 13, 2007 (JP) ..... 2007-156528

(51) Int. Cl.
*B41J 2/16* (2006.01)

(52) U.S. Cl. ..... 347/47

(58) Field of Classification Search ..... None
See application file for complete search history.

(56) References Cited

U.S. PATENT DOCUMENTS

| | | | | |
|---|---|---|---|---|
| 5,458,254 | A * | 10/1995 | Miyagawa et al. | 216/27 |
| 5,478,606 | A | 12/1995 | Ohkuma et al. | |
| 5,763,141 | A | 6/1998 | Shimomura et al. | |
| 6,123,863 | A | 9/2000 | Shimomura et al. | |
| 6,318,842 | B1 | 11/2001 | Shimomura et al. | |
| 6,390,606 | B1 | 5/2002 | Terui et al. | |
| 6,793,326 | B2 | 9/2004 | Imamura et al. | |
| 6,895,668 | B2 | 5/2005 | Imamura | |
| 2006/0222999 | A1 | 10/2006 | Miyazaki et al. | |
| 2006/0230614 | A1 | 10/2006 | Imamura et al. | |
| 2008/0160454 | A1 | 7/2008 | Shimomura et al. | |

FOREIGN PATENT DOCUMENTS

| | | | |
|---|---|---|---|
| JP | 03-184868 | A | 8/1991 |
| JP | 2007-038527 | A | 2/2007 |
| JP | 2007-136875 | A | 6/2007 |
| WO | 2005/019299 | A1 | 3/2005 |

* cited by examiner

*Primary Examiner* — Jerry Rahill
(74) *Attorney, Agent, or Firm* — Fitzpatrick, Cella, Harper & Scinto

(57) ABSTRACT

A liquid discharge head comprises a discharge port forming member having formed therein a discharge port arranged corresponding to an energy generating element which generates energy to eject a liquid and a flow path forming member for forming a flow path to supply ink to the discharge port. At least one of the discharge port forming member and the flow path forming member is made of a cured material of a composition containing an epoxy resin and a phenol resin having a higher oxygen equivalent than that of the epoxy resin.

7 Claims, 2 Drawing Sheets

LIQUID DISCHARGE HEAD

BACKGROUND OF THE INVENTION

1. Field of the Invention

The present invention relates to a liquid discharge head, and in particular, to an ink jet recording head which generates recording liquid droplets for use in an ink jet recording system.

2. Description of the Related Art

As an application in which a liquid discharge head is used, there is known an ink jet recording head which is applied to an ink jet recording system. The ink jet recording head generally includes fine ink discharge ports (hereinafter, referred to as "orifices"), liquid flow paths, and liquid ejection energy generating elements arranged in the liquid flow paths. As a method of manufacturing such an ink jet recording head, U.S. Pat. No. 5,478,606 and U.S. Pat. No. 6,390,606 discuss a method including the following steps.

First, an ink flow path pattern made of a soluble resin is formed on a substrate on which energy generating elements are formed. Next, a coating resin layer including an epoxy resin and a photopolymerization initiator is formed on the ink flow path pattern. The coating resin layer constitutes an ink flow path wall. Next, orifices are formed above the energy generating elements by photolithography. Finally, the soluble resin is removed by dissolution and the coating resin layer which constitutes the ink flow path wall is cured, to thereby form the ink flow path.

In recent years, with the development of a recording technology, highly precise and high-speed recording has been demanded in an ink jet recording technology. As a method which meets highly precise and high-speed recording, investigations of a method of minimizing and densely forming the orifices so as to minimize ink droplets ejected from the ink jet recording head are advanced. In particular, if the orifices are minimized, a member for forming the ink flow path wall is swollen by absorbing water. Accordingly, the area of each orifice may be changed. The change of the area of the orifice may affect printing. In addition, if the orifices are densely formed, that is, if the width of the ink flow path wall is decreased, the close contactness between the member for forming the ink flow path wall and the substrate may be deteriorated due to being swollen. That is, for the sake of minimizing and densely forming the orifices of the ink jet recording head, there is a need for a technology which can suppress ink absorption of the member for forming the ink flow path wall.

SUMMARY OF THE INVENTION

The present invention is directed to an ink jet recording head which can stably eject ink even if orifices are minimized and densely formed. Specifically, the present invention is directed to an ink jet recording head which can suppress a change in area of each orifice due to ink absorption by a member for forming an ink flow path wall, and can prevent the ink flow path wall from being separated.

One aspect of the present invention is described below. A liquid discharge head includes: a discharge port forming member having formed therein a discharge port arranged to correspond to an energy generating element which generates energy to eject a liquid; and a flow path forming member for forming a flow path to supply ink to the discharge port. At least one of the discharge port forming member and the flow path forming member is made of a cured material of a composition containing an epoxy resin and a phenol resin having a higher oxygen equivalent than that of the epoxy resin.

According to the aspect of the present invention, even if the orifices are minimized and densely formed, a highly reliable ink jet recording head can be provided which can suppress a change in area of an orifice due to ink absorption by a member for forming an ink flow path wall, and can prevent the ink flow path wall from being separated.

Further features of the present invention will become apparent from the following description of exemplary embodiments with reference to the attached drawings.

DESCRIPTION OF THE EMBODIMENTS

Embodiments of the present invention will now be described with reference to the drawings.

In the following description, an ink jet recording head which is an example of a liquid discharge head is described. The liquid discharge head may be adapted for use to eject medicine and to manufacture a color filter, in addition to the ink jet recording head.

The ink jet recording head can be mounted on printers, copy machines, facsimile machines having a communication system, word processors having a printer unit, and industrial recording apparatuses having incorporated therein various processing apparatuses. By using the ink jet recording head, recording can be performed on various kinds of recording mediums, such as papers, threads, fibers, textiles, leathers, metals, plastics, glasses, timbers, and ceramics. The term "recording" used herein means not only providing a meaningful image, such as a character or a figure, but also providing a meaningless image, such as a pattern, on a recording medium.

The term "ink" used herein can be construed widely and means a liquid that is provided on a recording medium to form an image, a figure, or a pattern thereon. In addition, the ink or the recording medium may be treated. The ink or the recording medium is treated as follows: a colorant contained in the ink is solidified or insolubilized, such that fixability, recording quality, chromaticity, and image durability can be improved.

Figure 1:
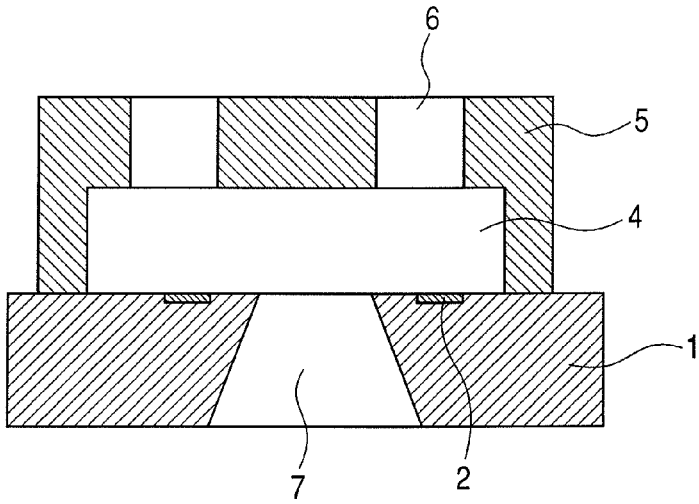
FIG. 1 is a schematic cross-sectional view illustrating an example of an ink jet recording head according to an exemplary embodiment of the present invention.
Figure 2:
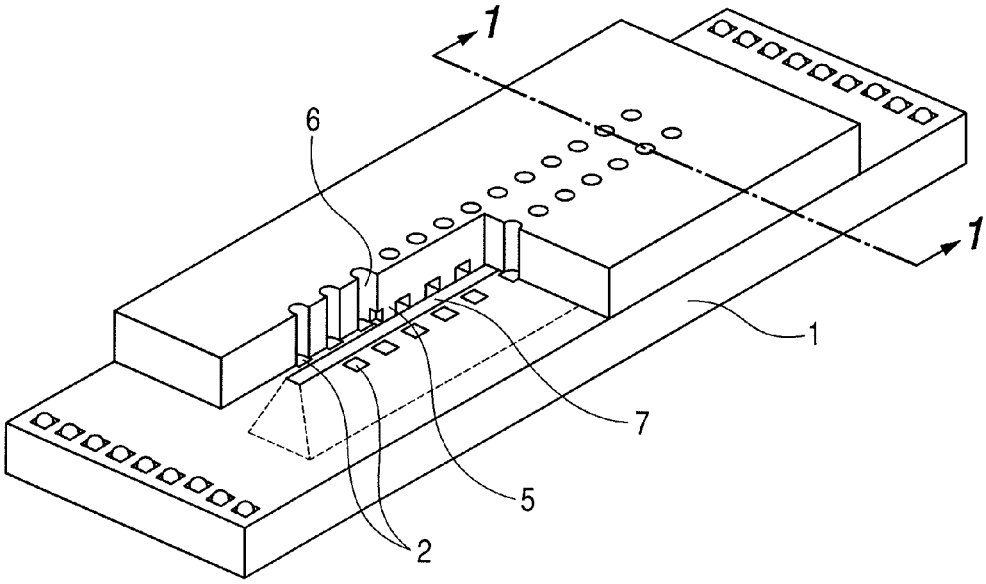
FIG. 2 is a schematic perspective view illustrating an example of an ink jet recording head according to an exemplary embodiment of the present invention.

FIG. 2 is a schematic perspective view illustrating an example of an ink jet recording head (hereinafter, referred to as "recording head") according to an embodiment of the present invention. FIG. 1 is a schematic cross-sectional view taken along the line 1-1 of FIG. 2.

A recording head according to the embodiment of the present invention has a substrate 1, made of silicon, including energy generating elements 2 for generating energy to eject a liquid. The energy generating elements 2 are arranged in two lines by predetermined intervals. The substrate 1 has a supply port 7 that is formed by anisotropic etching of silicon to extend between the two lines of the energy generating elements 2. The substrate 1 is overlaid with the flow path forming member 5 which has discharge ports 6 located at positions corresponding to the energy generating elements and a flow path 4 communicatively connecting the supply port 7 to the discharge ports 6. The positions of the discharge ports are not limited to the positions corresponding to the energy generating elements. For example, a so-called back shooter type head in which a heater serving as an energy generating element is used and ejected ink goes toward a side opposite to a growing bubble in the ink through the heater may be used. In this embodiment, the flow path forming member 5 also functions as a discharge port forming member which forms the discharge ports 6. Alternatively, the discharge port forming member which forms the discharge ports 6 may be provided separately from the flow path forming member 5.

In the recording head which is an example of the liquid discharge head according to the embodiment of the present invention, at least one of the flow path forming member for forming the flow path and the discharge port forming member for forming the discharge ports is made of a cured material including an epoxy resin having two or more epoxy groups and a phenol resin having a higher oxygen equivalent than that of the epoxy resin. The discharge port forming member and the flow path forming member can be both made of a cured material including an epoxy resin having two or more epoxy groups and a phenol resin having a higher oxygen equivalent than that of the epoxy resin. Materials for the flow path forming member and the discharge port forming member of the recording head according to the embodiment of the present invention are as follows.

The epoxy resin is not particularly limited insofar as the epoxy resin has two or more epoxy groups. Examples of the epoxy resin include alicyclic epoxy resins, such as 1,2-epoxy-4-(2-oxylanyl)cyclohexane adduct of 2,2-bis(hydroxymethyl)-1-butanol (Formula III), bisphenol-type epoxy resins, novolac-type epoxy resins, and glycidyl ester-type epoxy resins. As the epoxy resin expressed by Formula III, for example, "EHPE3150" (Product Name, manufactured by Daicel Chemical Industries, Ltd.) is placed on the market. When the epoxy resin is used for photolithography, a pattern having a high aspect ratio can be obtained.

Formula III (III)

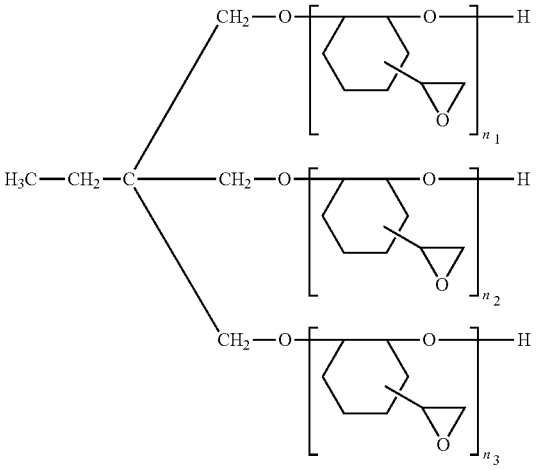

Here, $n_1$, $n_2$, and $n_3$ are natural numbers.

The phenol resin is not particularly limited insofar as the phenol resin has a higher oxygen equivalent (a molecular weight per oxygen atom with respect to a compound) than that of the epoxy resin. Examples of the phenol resin include compounds expressed by Formulas I and II, and also include bisphenol derivatives, catechol derivatives, and resorcin derivatives. As the compound expressed by Formula I, for example, "DPP-M" (Product Name, manufactured by Nippon Oil Co., Ltd.) is placed on the market. As the compound expressed by Formula II, for example, "MILEX XLC-4L" (Product Name, manufactured by Mitsui Chemicals, Inc.) is placed on the market. The compound expressed by Formula III has an oxygen equivalent of 68, the compound expressed by Formula I has an oxygen equivalent of 165, and the compound expressed by Formula II has an oxygen equivalent of 175. These phenol resins have a higher oxygen equivalent than that of the epoxy resin expressed by Formula III. Accordingly, a cured material including the epoxy resin expressed by Formula III and the phenol resin expressed by Formula II has a lower water-absorbing property than a cured material only including the resin expressed by Formula III. The resin expressed by Formula II includes a phenol group and the resin expressed by Formula I includes a bicyclo skeleton. Accordingly, a water absorption rate is reduced, and chemical resistance is increased.

Formula I (I)

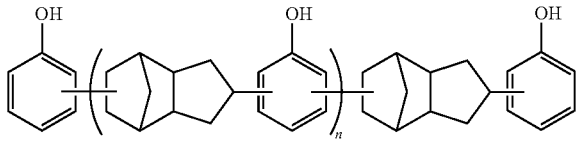

Formula II (II)

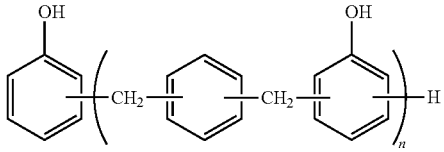

According to the embodiment of the present invention, the blending amount of the phenol resin can be in a range of 20 parts by mass to 30 parts by mass with respect to 100 parts by mass of the epoxy resin. In view of reduction of ink absorption of the discharge port forming member or the flow path forming member, the blending amount of the phenol resin can be no less than 20 parts by mass with respect to 100 parts by mass of the epoxy resin. In addition, when the flow path forming member or the discharge port forming member is patterned by photolithography, the blending amount of the phenol resin can be no more than 40 parts by mass with respect to 100 parts by mass of the epoxy resin. When patterning by photolithography is not particularly needed while the discharge ports or the flow path is formed, the phenol resin can be blended in an amount of more than 40 parts by mass with respect to 100 parts by mass of the epoxy resin.

As a curing agent for obtaining the cured material of the epoxy resin and the phenol resin, for example, a photopolymerization initiator may be used. Examples of the photopolymerization initiator include sulfonium salt-based photopolyermization initiators, halogenated triazine compounds, and diphenyliodonium salt derivatives. As the sulfonium salt-based photopolymerization initiator, "SP-172" (Product Name, manufactured by Adeka Corporation) is placed on the market.

The blending amount of the photopolymerization initiator can be in a range of 1 part by mass to 10 parts by mass with respect to 100 parts by mass of the epoxy resin. In view of sufficient curing, the blending amount of the photopolymerization initiator can be no less than 1 part by mass with respect to 100 parts by mass of the epoxy resin. In addition, the blending amount of the photopolymerization initiator can be in a range of 2 parts by mass to 6 parts by mass with respect to 100 parts by mass of the epoxy resin.

Next, an example of a method of manufacturing an ink jet recording head will be described. A process for manufacturing the recording head shown in FIG. 1 will be described with reference to FIGS. 3A-3D.

Figure 3A:
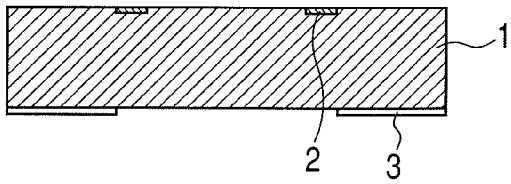
FIGS. 3A, 3B, 3C and 3D are schematic cross sectional views illustrating an example of a method of manufacturing an ink jet recording head according to an exemplary embodiment of the present invention.

As shown in FIG. 3A, the substrate 1 which has arranged thereon the energy generating elements 2 on the front surface and a mask 3 for forming the ink supply port on the rear surface is prepared.

Figure 3B:
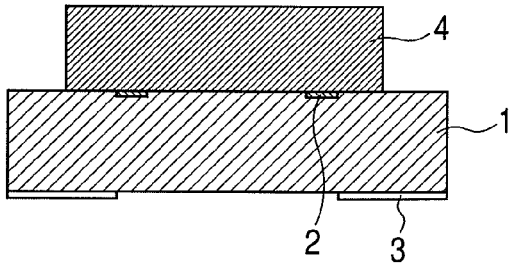

Next, as shown in FIG. 3B, an ink flow path pattern 4 made of a soluble resin is formed. Examples of the soluble resin include an acrylic positive-type resist and polymethyl isoprophenyl ketone.

Figure 3C:
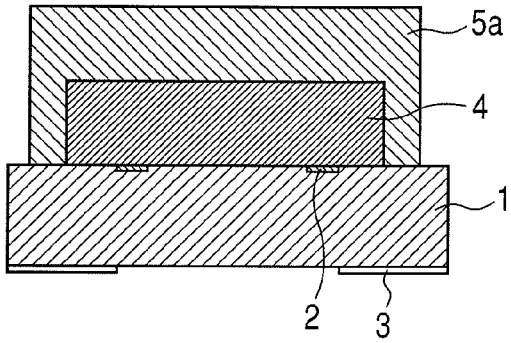

Next, as shown in FIG. 3C, a coating resin layer 5*a* which is an ink flow path wall forming member is formed on the substrate 1 on which the ink flow path pattern 4 is formed. The coating resin layer 5*a* may be formed, for example, by solvent coating. In this case, the coating resin layer 5*a* includes an epoxy resin having two or more epoxy groups and a phenol resin having a higher oxygen equivalent than that of the epoxy resin.

Next, ink discharge ports 6 are formed in the coating resin layer 5*a* above the energy generating elements 2 by photolithography. According to the embodiment of the present invention, the ink discharge ports 6 may be orifices which are minimized to have a diameter of 6 to 10 μm, or orifices which are densely formed at an interval of 20 to 40 μm.

Next, an ink supply port 7 is formed on the rear surface of the substrate 1, and the ink flow path pattern 4 is removed. Since the ink flow path pattern 4 is made of a soluble resin, it can be removed by dissolution. The ink supply port 7 may be formed, for example, by anisotropic etching of the silicon substrate. Next, the coating resin layer 5*a* is cured, thereby manufacturing the ink jet recording head having the construction shown in FIG. 1.

EXAMPLES

In the examples, compositions shown in Table 1 were used as the material for forming the ink flow path forming member, and an ink jet recording head was manufactured by the following manufacturing method.

First, an ink flow path pattern made of a positive-type resist (Product Name: ODUR-1010A, manufactured by Tokyo Ohka Gokyo Co., Ltd.) was formed on the substrate 1 (FIG. 3B).

Next, a composition corresponding to each of Examples 1 to 10 shown in Table 1 (an epoxy resin, a phenol resin (Here, the total weight of the epoxy resin and the phenol resin is identical to No. of each of Example 1 to 10.), and a photopolymerization initiator (Product Name: SP-172, manufactured by Adeka Corporation) of 5% with respect to the resin component) was dissolved in xylene. The mixture was coated by solvent coating, thereby forming the coating resin layer 5*a* (FIG. 3C).

Figure 3D:
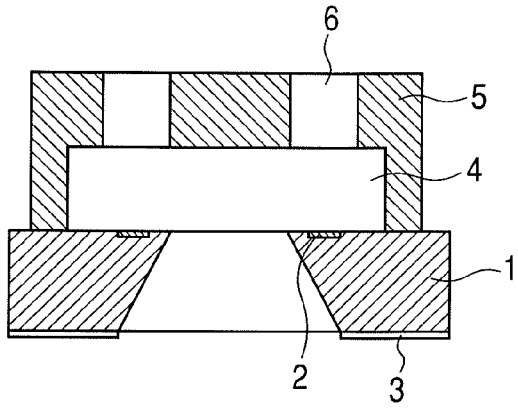

Next, the orifices were formed to have a diameter of 8 μm by photolithography, then the ink supply port 7 was formed by anisotropic etching of the silicon substrate 1, and subsequently the ink flow path pattern 4 was removed (FIG. 3D).

Next, in order to cure the coating resin layer, heat treatment was performed for 1 hour at 200° C. In this way, ink jet recording heads having the construction shown in FIG. 1 and corresponding to the examples were manufactured.

Comparative Example 1

The same process was performed except that a composition corresponding to Comparative Example in Table 1 was used as the material for forming the ink flow path forming member. Comparative Example 1 is different from Example 1 in that no phenol resin is added.

(Estimation)

For the ink jet recording heads manufactured in the above-described manner, the shapes of the discharge ports were observed, and the patterning property was estimated.

The obtained recording heads were dipped in an ink containing ethylene glycol, urea, isopropyl alcohol, a black dye, and water in a mass ratio of 5:3:2:3:87 for 2 weeks below 60° C. Thereafter, the change in area of the discharge port was observed. In addition, after the recording heads were dipped in the same ink and subjected to a PCT test for 10 hours at 121° C. and 2 air pressure, the contact state of the flow path forming member and the substrate was observed.

The results are shown in Table 1.

TABLE 1

| | Examples | | | | | | | | | | Comparative Example |
|---|---|---|---|---|---|---|---|---|---|---|---|
| Epoxy Resin | EHPE-3150 (Product Name, manufactured by Daicel Chemical Industries, Ltd.) | | | | | | | | | | |
| Phenol Resin | DPP-M (Product Name, manufactured by Nippon Oil Co., Ltd.) | | | | | MILEX XLC-4L (Product Name, manufactured by Mitsui Chemicals, Inc.) | | | | | None |
| No | 1 | 2 | 3 | 4 | 5 | 6 | 7 | 8 | 9 | 10 | |
| % by weight of Phenol Resin with respect to 100% by weight of Epoxy Resin | 10 | 20 | 30 | 40 | 50 | 10 | 20 | 30 | 40 | 50 | 0 |
| Evaluation of Ink Absorption Resistance | ○ | ⊙ | ⊙ | ⊙ | ⊙ | ○ | ⊙ | ⊙ | ⊙ | ⊙ | Δ |
| Evaluation of Flow path Separation | ○ | ⊙ | ⊙ | ⊙ | ⊙ | ○ | ⊙ | ⊙ | ⊙ | ⊙ | Δ |
| Evaluation of Patterning | ⊙ | ⊙ | ⊙ | ○ | □ | ⊙ | ⊙ | ⊙ | ○ | ○ | ⊙ |

* DPP-M (Product Name, manufactured by Nippon Oil Co., Ltd.) is the compound expressed by Formula I.
* MILEX XLC-4L (Product Name, manufactured by Mitsui Chemicals, Inc.) is the compound expressed by Formula II.

(Evaluation of Ink Absorption Resistance)

⊙: a change in area of the discharge port is less than 5%

○: a change in area of the discharge port is in a range of 5% to 10%

Δ: a change in area of the discharge port is more than 10%

(Evaluation of Flow Path Wall Separation)

⊙: separation between the flow path forming member and the substrate is not observed ○: slight separation is observed, but there is no damage Δ: separation is observed in some samples (Evaluation of Patterning)

⊙: no round edge is observed in the discharge port

○: a slight round edge is observed in the discharge port, but there is no affect on ejection □: a round edge is observed in the discharge port. There is a slight affect on ejection, but no affect on an image.

As described above, according to the examples of the present invention, it is possible to obtain a highly reliable ink jet recording head that can suppress the change in diameter of the orifice and can enable ink ejection for a long time. In addition, it can be seen from the comparison of Examples 5 and 10 that the compound expressed by Formula II achieves a slightly better patterning property than the compound expressed by Formula I.

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-156528, filed Jun. 13, 2007 which is hereby incorporated by reference herein in its entirety.

What is claimed is:

1. A liquid discharge head, comprising:

a discharge port forming member having formed therein a discharge port arranged corresponding to an energy generating element which generates energy to eject a liquid; and a flow path forming member for forming a flow path to supply the liquid to the discharge port, wherein at least one of the discharge port forming member and the flow path forming member is made of a cured material of a composition containing an epoxy resin and a phenol resin having a higher oxygen equivalent than that of the epoxy resin, the phenol resin being expressed by the following formula:

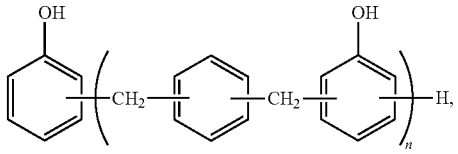

where n is a natural number.

2. The liquid discharge head according to claim 1, wherein the epoxy resin is a compound expressed by the following formula:

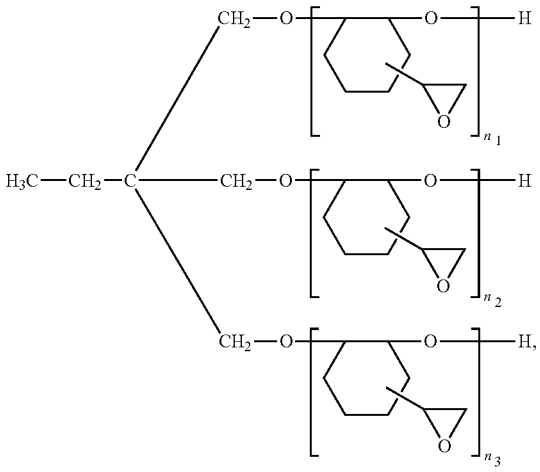

where $n_1$, $n_2$, and $n_3$ are natural numbers.

3. The liquid discharge head according to claim 1, wherein the phenol resin is blended in an amount of no less than 20 parts by weight with respect to the epoxy resin.

4. The liquid discharge head according to claim 1, wherein the flow path forming member and the discharge port forming member are both made of a cured material of the epoxy resin and the phenol resin having a higher oxygen equivalent than that of the epoxy resin.

5. The liquid discharge head according to claim 1, wherein the energy generating element and the flow path forming member are arranged on a common substrate.

6. The liquid discharge head according to claim 1, wherein the discharge port is arranged at a position to face the energy generating element.

7. The liquid discharge head according to claim 1, wherein the discharge port forming member and the flow path forming member are integrally formed.

* * * * *